US008584646B2

(12) United States Patent
Takeuchi et al.

(10) Patent No.: US 8,584,646 B2
(45) Date of Patent: Nov. 19, 2013

(54) CHAIN CASE STRUCTURE FOR ENGINE

(75) Inventors: Kensuke Takeuchi, Shizuoka-Ken (JP); Junji Kuroda, Shizuoka-Ken (JP)

(73) Assignee: Suzuki Motor Corporation, Hamamatsu-shi, Shizuoka-Ken (JP)

( * ) Notice: Subject to any disclaimer, the term of this patent is extended or adjusted under 35 U.S.C. 154(b) by 0 days.

(21) Appl. No.: 13/700,446

(22) PCT Filed: May 27, 2011

(86) PCT No.: PCT/JP2011/062187
§ 371 (c)(1),
(2), (4) Date: Nov. 28, 2012

(87) PCT Pub. No.: WO2011/152302
PCT Pub. Date: Dec. 8, 2011

(65) Prior Publication Data

US 2013/0068191 A1 Mar. 21, 2013

(30) Foreign Application Priority Data

May 31, 2010 (JP) ..... 2010-123857

(51) Int. Cl.
*F02F 7/00* (2006.01)

(52) U.S. Cl.
USPC ..... 123/195 C; 123/195 R; 123/198 E; 74/606 R

(58) Field of Classification Search
USPC ..... 123/195 R, 195 C, 198 E, 90.31, 123/90.15–90.18; 74/606 R
See application file for complete search history.

(56) References Cited

U.S. PATENT DOCUMENTS

| | | | | |
|---|---|---|---|---|
| 6,766,714 | B2 * | 7/2004 | Iwata et al. | 74/606 R |
| 7,255,085 | B2 * | 8/2007 | Shin | 123/195 C |
| 7,546,824 | B2 * | 6/2009 | Ando | 123/90.31 |
| 8,387,576 | B2 * | 3/2013 | Iwata | 123/90.17 |
| 8,511,268 | B2 * | 8/2013 | Hoshito | 123/90.17 |

FOREIGN PATENT DOCUMENTS

| | | | | |
|---|---|---|---|---|
| JP | 05203019 A | * | 8/1993 | F16H 57/02 |
| JP | 2001207860 A | | 8/2001 | |
| JP | 2008157096 A | | 7/2008 | |
| JP | 2008174113 A | | 7/2008 | |
| JP | 2008215323 A | | 9/2008 | |

OTHER PUBLICATIONS

Search Report for International Patent Application No. PCT/JP2011/062187; Aug. 9, 2011.
International Preliminary Report on Patentability and English Translation of the Written Opinion of the International Searching Authority, dated Jan. 8, 2013.

* cited by examiner

*Primary Examiner* — Noah Kamen
*Assistant Examiner* — Grant Moubry
(74) *Attorney, Agent, or Firm* — Barnes & Thornburg LLP

(57) ABSTRACT

A chain case structure of an engine, wherein, when a chain case is viewed in the crankshaft direction, both side portions of a mount bracket unit in the width direction extend to the left edge portion or the right edge portion of the chain case and the upper edge portion of the chain case, and a fastening portion to an engine main body is provided on the lower portion of the mount bracket portion. A cylinder portion of a hydraulic control valve of a variable valve mechanism is disposed below the fastening portion while the outer peripheral surface of the cylinder portion is mutually coupled to the mount bracket portion. Reinforcement ribs extend downward from the bottom of the mount bracket, across the cylinder portion.

5 Claims, 6 Drawing Sheets

CHAIN CASE STRUCTURE FOR ENGINE

PRIORITY CLAIM

This patent application is a U.S. National Phase of International Patent Application No. PCT/JP2011/062187, filed 27 May 2011, which claims priority to Japanese Patent Application No. 2010-123857, filed 31 May 2010, the disclosures of which are incorporated herein by reference in their entirety.

TECHNICAL FIELD

The present invention relates to a chain case structure for an engine, and more particularly, to a chain case structure for an engine equipped with hydraulic control valves of a variable valve actuation mechanism.

BACKGROUND TECHNOLOGY

Some vehicle engines are equipped with a variable valve actuation mechanism which includes a hydraulic actuator mounted on a cam shaft and operated on hydraulic pressure supplied through hydraulic control valves (OCVs) and which changes a rotation phase of the cam shaft with respect to a crank shaft. In this case, the hydraulic control valves are generally mounted on a chain case which covers a timing chain of the engine.

PRIOR ART DOCUMENT

Patent Documents

Patent Document 1: Japanese Patent Laid-Open Publication No. 2008-174113

Patent Document 2: Japanese Patent Laid-Open Publication No. 2008-215323

An engine mount structure equipped with a variable valve timing mechanism (variable valve actuation mechanism) disclosed in Patent Document 1 is shown in FIG. 8.

With the illustrated mount structure, in a chain case 101 that covers a timing chain, a mounting bracket unit 102 is linked to a lower portion of an actuator cover unit, a stepped portion of the actuator cover unit is extended toward the mounting bracket unit 102 in a planar fashion, and a lower end of the stepped portion is joined to the mounting bracket unit. In addition, the mounting bracket unit 102 as well as a cylinder unit 104 adapted to accept insertion of a hydraulic control valve 103 are formed on an outer wall of the chain case 101.

An engine equipped with a variable valve timing mechanism (variable valve actuation mechanism) disclosed in Patent Document 2 has a structure in which a mounting bracket unit is disposed at a location deviated to one side from a cylinder axis below an actuator cover unit of a chain case adapted to cover a timing chain, two hydraulic control valves are disposed on a lateral side of the mounting bracket unit with axes of the hydraulic control valves overlapping each other and facing a direction orthogonal to a crank shaft axis, and the mounting bracket unit as well as cylinder units adapted to accept insertion of the hydraulic control valves are formed on an outer wall of the chain case.

DISCLOSURE OF THE INVENTION

Problems to be Solved by the Invention

However, with a conventional technique disclosed in Patent Document 1 described above, the cylinder unit is placed above the mounting bracket unit, and in this arrangement, the cylinder unit needs to be placed at a location which does not overlap a flat seat in a crank shaft direction for fastening a bracket by extending to a vehicle-body side on a top face of the mounting bracket unit. Such structure makes it difficult to restrain vertical movements of the mounting bracket unit using the cylinder unit, resulting in a disadvantage of occurrence of vibrations.

Furthermore, according to Patent Document 2 described above, two cylinder units are placed on a lateral side of the mounting bracket unit to accept insertion of the hydraulic control valves, and the cylinder units will disadvantageously deform with vertical movements of the mounting bracket unit, resulting in reduced durability of the hydraulic control valves.

Thus, in view of the conventional techniques described above, an object of the present invention is to provide a chain case structure for an engine, including a chain case equipped with a mounting bracket unit and cylinder units adapted to accept insertion of hydraulic control valves, capable of preventing vibrations of the chain case and deformation of the cylinder units from occurring, thereby improving durability of the hydraulic control valves.

Means for Solving the Problems

A preferred embodiment of the present invention to achieve the above object provides a chain case structure for an engine, in which a chain case is disposed at an end of an engine body of an engine such that a left edge and a right edge of the chain case are joined to an end of the engine body below a head cover of an engine and an upper edge of the chain case is joined to a lower portion of the head cover, and in which a mount bracket unit adopted to support the engine body and a cylinder unit, into which a hydraulic control valve of a variable valve actuation mechanism is inserted into a cylinder unit, are disposed so as to bulge out from an outer wall of the chain case, wherein both side portions of the mounting bracket unit in a width direction thereof are disposed so as to extend to one of the left edge and the right edge of the chain case and to the upper edge thereof, respectively, when the chain case is viewed in a direction of a crank shaft of the engine, a fastener adapted to fasten to the engine body is mounted to a lower portion of the mounting bracket unit, the cylinder unit is arranged under the fastener with an outer circumferential surface of the cylinder unit being coupled to the mounting bracket unit, and a reinforcement rib is disposed under the mounting bracket unit so as to extend downward from the mounting bracket unit by traversing the cylinder unit.

Further, the embodiment of the above aspect may include the following modes.

It may be preferred that the reinforcement rib is disposed so as to extend from a lateral side of the fastener to another one of the left edge and the right edge of the chain case.

It may be also preferred that the reinforcement rib is disposed so as to obliquely intersect an axis of the cylinder unit.

Furthermore, it is preferred that a plurality of the cylinder units may be disposed below the mounting bracket unit in a manner being overlapped one over another in a vertical direction, and a lower cylinder unit of the plurality of cylinder units may be offset from an upper cylinder unit thereof toward another one of the left edge and the right edge of the chain case in a direction along the outer wall of the chain case.

It may be also preferred that a plurality of the cylinder units are disposed below the mounting bracket unit in a manner being overlapped one over another in a vertical direction, and when the chain case is viewed in a direction orthogonal to the crank shaft, an upper cylinder unit of the plurality of cylinder units may be offset so as to be located further outside in the axial direction of the crank shaft than a lower cylinder unit of the plurality of the cylinder units.

Effects of the Invention

According to the chain case structure for an engine of the embodiment of the present invention, vibrations of the chain case of the engine and deformation of the cylinder units can be prevented from occurring, thereby improving durability of the hydraulic control valves.

Further features of the present invention will become apparent from the following description made with reference to the accompanying drawings.

EMBODIMENTS FOR CARRYING OUT THE INVENTION

The present invention achieves the objects of preventing vibrations of a chain case of an engine and deformation of cylinder units from occurring, thereby improving durability of hydraulic control valves by extending opposite side portions of a mounting bracket unit in a width direction to one of a left edge and right edge of the chain case and to an upper edge of the chain case, the chain case being joined to the engine, and by fastening lower portion of the mounting bracket unit to the engine using a fastener.

A preferred mode of the present invention of the characters mentioned above will be described hereunder as an embodiment. It is further to be noted that, in the following description, terms which indicate directions, such as "vertical" (up/down) and "right/left", are used under illustrated conditions.

Embodiment

An embodiment of the present invention will be described with reference to FIGS. 1 to 7.

Figure 1:
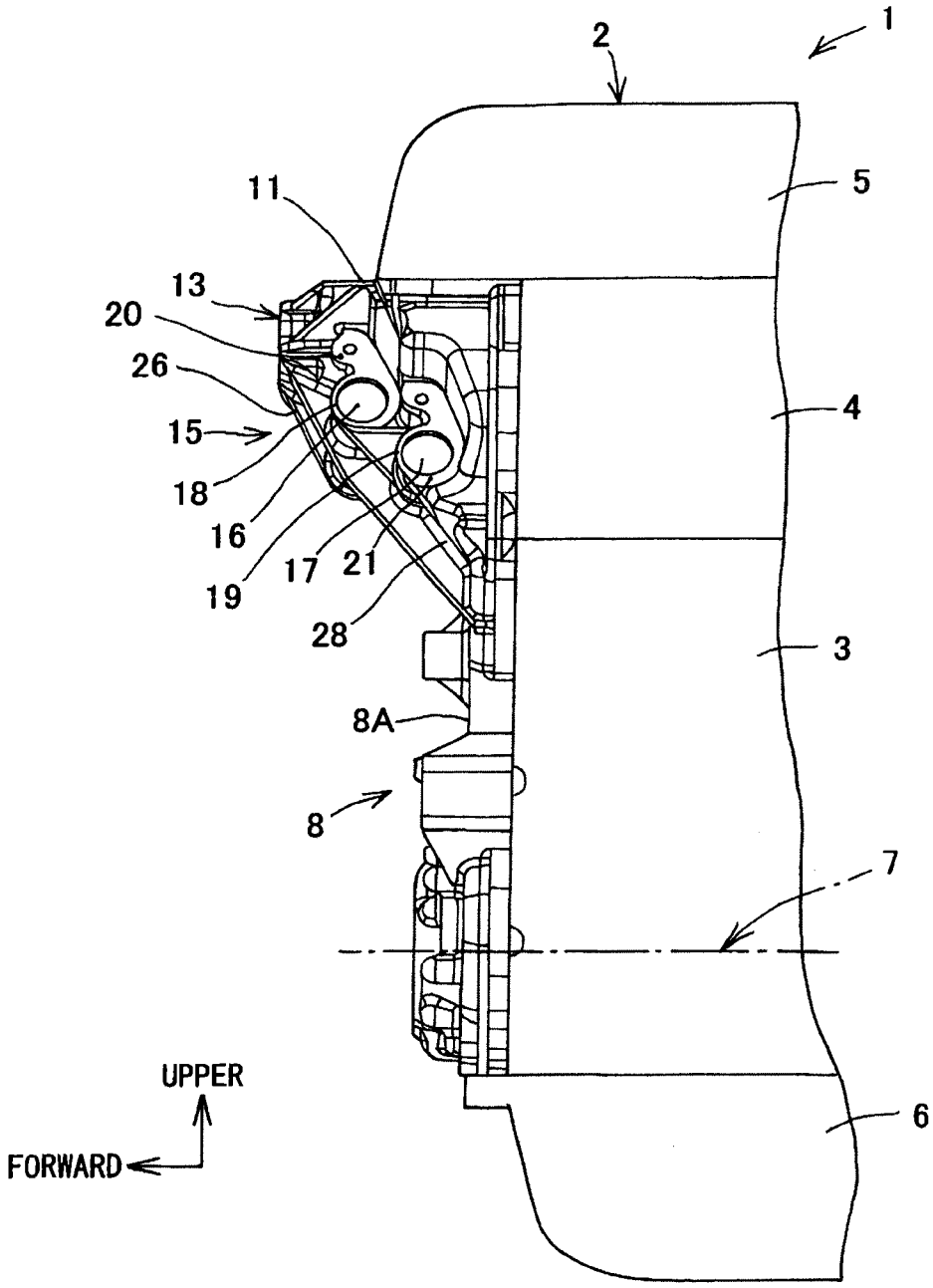
FIG. 1 is a side view of front portion of an engine according to an embodiment of the present invention.

In FIG. 1, reference numeral 1 denotes an engine mounted on a vehicle and equipped with a variable valve actuation mechanism.

The engine 1 includes an engine body 2 which in turn includes a cylinder block 3, a cylinder head 4, a head cover 5, and an oil pan 6. A crank shaft 7 is rotatably mounted in the cylinder block 3.

A chain case 8 adapted to cover a timing chain of the engine 1 is placed at an end of the engine body 2. The chain case 8 is mounted on a front end of the cylinder block 3 and cylinder head 4.

Figure 2:
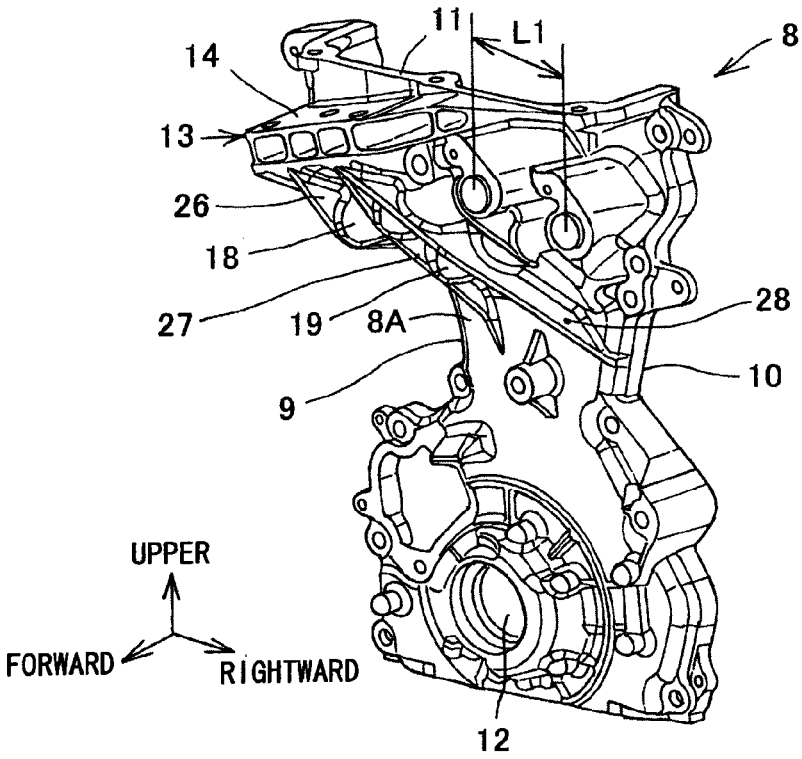
FIG. 2 is a perspective view of a chain case of the engine shown in FIG. 1.
Figure 3:
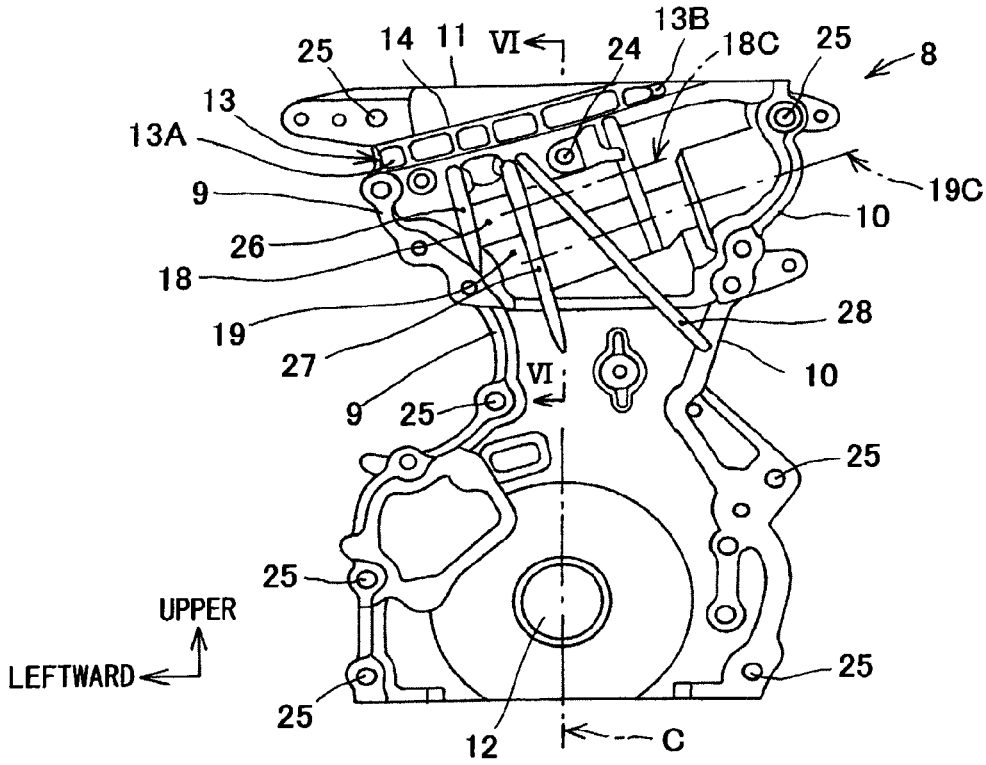
FIG. 3 is a front view of the chain case.
Figure 4:
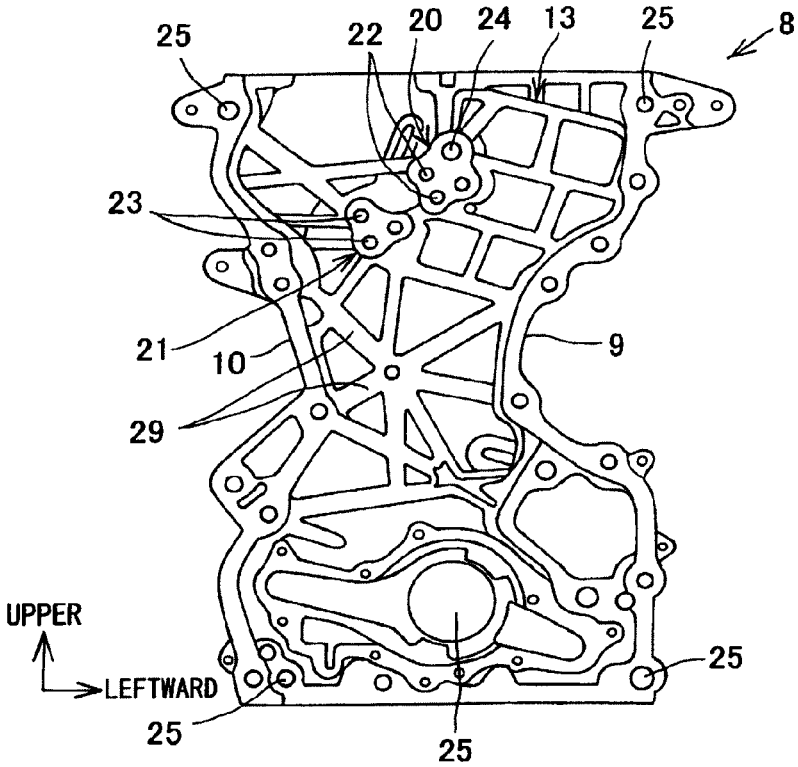
FIG. 4 is a rear view of the chain case.
Figure 5:
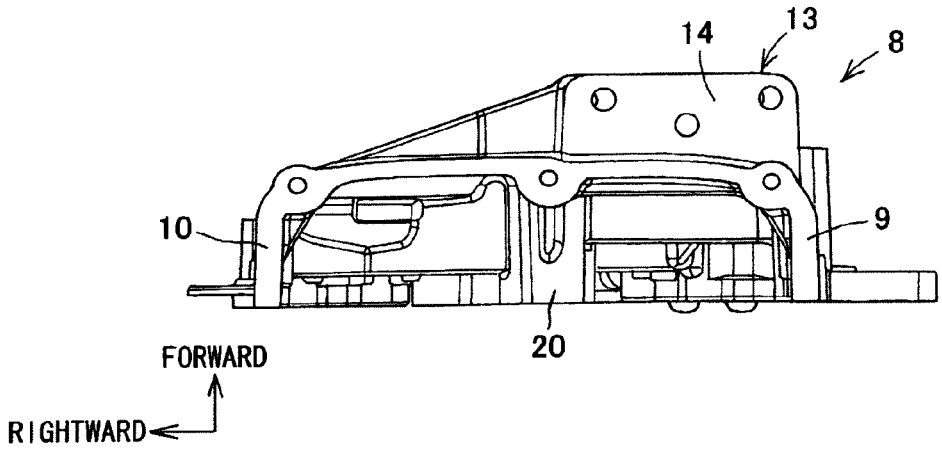
FIG. 5 is a plan view of the chain case.
Figure 6:
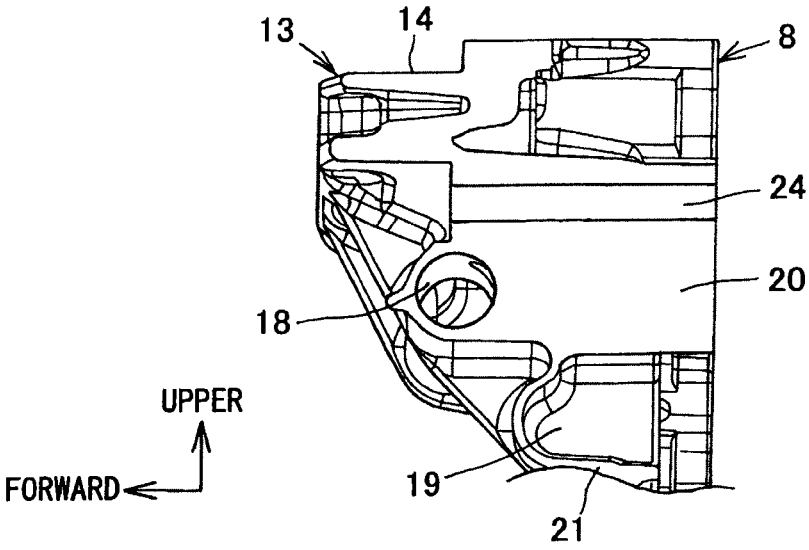
FIG. 6 is a sectional view of the chain case in FIG. 3 taken along the line VI-VI.

As shown in FIGS. 1 and 2, the chain case 8 has a left edge 9 and right edge 10 joined to an end of the engine body 2 under the head cover 5, and has an upper edge 11 joined to the lower portion of the head cover 5. As also shown in FIGS. 2 to 4, a crank shaft hole 12 adapted to pass the crank shaft 7 is formed in the chain case 8.

A mounting bracket unit 13 to support the engine body 2 to a vehicle body is mounted on the upper portion of the chain case 8. A flat seat 14 used to fasten a bracket extending to a vehicle-body side is formed on a top face of the mounting bracket unit 13.

In addition, two cylinder units adapted to accept insertion of a plurality of hydraulic control valves (OCVs) of a variable valve actuation mechanism 15 are installed on an inner surface of the upper portion of the chain case 8, where the plural hydraulic control valves are, for example, two control valves of a first hydraulic control valve 16 and second hydraulic control valve 17, which are inserted into two cylinder units, which are a first cylinder unit 18 and second cylinder unit 19.

As shown in FIG. 1, the mounting bracket unit 13, and first and second cylinder units 18 and 19 bulge outward from an outer wall 8A of the chain case 8.

As shown in FIGS. 1, 2, 4 and 7, the first cylinder unit 18 and second cylinder unit 19 are joined to the cylinder head 4 by a first cylinder boss portion 20 and a second cylinder boss portion 21, respectively. A plurality of first oil passages 22 and second oil passages 23 are formed in the first cylinder boss portion 20 and the second cylinder boss portion 21, respectively, as oil passages of the variable valve actuation mechanism 15.

As shown in FIG. 4, in the first cylinder boss portion 20 and the second cylinder boss portion 21, in order to consolidate oil passages in a center region of the cylinder head 4, the first oil passages 22 and second oil passages 23 are formed close to each other and one above the another in a center in that portion of the chain case 8 which is located on a side of the cylinder head 4.

Furthermore, since the first and second (two) cylinder units 18 and 19, and the mounting bracket unit 13 are disposed in a small region on the side of the cylinder head 4, seating surfaces of the first hydraulic control valve 16 and the second hydraulic control valve 17 are disposed one over the another in a vertical direction, being offset in a crank shaft direction. This allows the oil passages of the variable valve actuation mechanism 15 to be located together in a small region, thereby securing space for installation of the mounting bracket unit 13.

Still furthermore, by disposing the mounting bracket unit 13 above the first cylinder unit 18 and the second cylinder unit 19, it becomes possible not only to reduce deformation of the mounting bracket unit 13, but also to reduce size and weight of the chain case 8, and it becomes also possible to reduce a flat portion on the outer wall 8A of the chain case 8 and reduce radiated sound in the chain case smaller than in a conventional structure.

As shown in FIGS. 2 to 4, when the chain case 8 is viewed in the crank shaft direction, both side portions 13A and 13B of the mounting bracket unit 13 in a width direction extend to one of the left edge 9 and right edge 10 of the chain case 8 and to the upper edge 11 of the chain case 8, respectively. The term "one edge" here means an edge positioned relatively on an upper side, out of the left edge 9 and right edge 10 in an arrangement in which the chain case is tilted such that the flat seat 14 of the mounting bracket unit 13 will face a horizontal direction and the engine 1 is put in such a posture as to be mounted on the vehicle body while "another edge" means an edge positioned on a lower side.

Furthermore, in a central region in the width direction in upper portion of the chain case 8, a fastener 24 for use to fasten to the engine body 2 is disposed in a lower portion of the mounting bracket unit 13. In addition, a plurality of outer peripheral fasteners 25 are disposed on an outer edge region of the chain case 8.

The first cylinder unit 18 and the second cylinder unit 19, whose axes are substantially parallel to each other, are arranged under the fastener 24 with outer circumferential surfaces of the cylinder units 18 and 19 being coupled to the mounting bracket unit 13.

Furthermore, for example, three reinforcement ribs, including first to third reinforcement ribs 26 to 28, are disposed at predetermined intervals under the mounting bracket unit 13 so as to extend downward from the mounting bracket unit 13 by traversing the first cylinder unit 18 and the second cylinder unit 19. Incidentally, the number of reinforcement ribs is not limited to three as illustrated, and may be changed as required.

Still furthermore, as shown in FIG. 4, a plurality of inner ribs 29 are mounted in a predetermined manner on an inside surface of the chain case 8 to enhance rigidity of the chain case 8.

In the manner mentioned above, by extending both the side portions 13A and 13B of the mounting bracket unit 13 in the width direction to one of the left edge 9 and right edge 10 of the chain case 8 and to the upper edge 11 of the chain case 8 joined to the engine, and by fastening the lower portion of the mounting bracket unit 13 to the engine body 2 using the fastener 24, it is possible to increase the supporting rigidity of the mounting bracket unit 13, thereby reducing vertical vibrations of the mounting bracket unit 13.

Moreover, since the first cylinder unit 18 and the second cylinder unit 19 are arranged under the fastener 24 in a manner such that the outer circumferential walls of the cylinder units 18 and 19 are coupled to the mounting bracket unit 13, it is possible to reduce the deformation of the first cylinder unit 18 and the second cylinder unit 19 by means of the fastener 24 while using the first cylinder unit 18 and the second cylinder unit 19 as reinforcing members of the mounting bracket unit 13.

Furthermore, since the first to third reinforcement ribs 26 to 28 are disposed under the mounting bracket unit 13 so as to extend downward from the mounting bracket unit 13 by traversing the first cylinder unit 18 and the second cylinder unit 19, it is possible to distribute the loads acting on the first cylinder unit 18 and the second cylinder unit 19 over the entire chain case 8 using the first to third reinforcement ribs 26 to 28, thereby reducing the deformation of the first cylinder unit 18 and the second cylinder unit 19.

According to the arrangement mentioned above, it becomes possible to prevent the vibrations of the chain case 8 as well as the deformation of the first cylinder unit 18 and the second cylinder unit 19, thereby improving the durability of the first hydraulic control valve 16 and the second hydraulic control valve 17 which are inserted in the first cylinder unit 18 and the second cylinder unit 19, respectively.

As shown in FIGS. 2 and 3, the first to third reinforcement ribs 26 to 28 are formed in linear shapes and at least one of the first to third reinforcement ribs 26 to 28 is arranged so as to extend from a lateral side of the fastener 24 to another of the left edge 9 and right edge 10.

That is, the first reinforcement rib 26 is disposed so as to extend from the lateral side of the fastener 24 downward to the left edge 9 and connected to the left edge 9. The second reinforcement rib 27 is disposed so as to extend downward in a direction of the crank shaft 7 to a center line C of the chain case 8 from the lateral side of the fastener 24 located away from the first reinforcement rib 26. The third reinforcement rib 28 is also disposed so as to extend from the lateral side of the fastener 24, in the same location as the second reinforcement rib 27, downward to the right edge 10 and connected to the right edge 10. In such arrangement of the reinforcement ribs, the first cylinder unit 18 and the second cylinder unit 19 are located at an intermediate portion in a longitudinal direction of the first to third reinforcement ribs 26 to 28.

According to the structures mentioned above, both the opposite ends of the third reinforcement rib 28 in the longitudinal direction can be extended to lateral side portions, such as the fastener 24 and another portion of the left edge 9 and right edge 10, fixed to the engine body 2. This makes it possible to further reduce the deformation of the first cylinder unit 18 and the second cylinder unit 19 located at the intermediate portion in the longitudinal direction of the third reinforcement rib 28. That is, although if only a single reinforcement rib is used at the lower portion of the mounting bracket unit 13, the first cylinder unit 18 and the second cylinder unit 19 will be entirely deformed, by disposing the third reinforcement rib 28, that is one of the first to third reinforcement ribs 26 to 28, to a lower portion of the mounting bracket unit 13 in such a manner as to overlap the first cylinder unit 18 and the second cylinder unit 19, it becomes possible to reduce the deformation of the first cylinder unit 18 and the second cylinder unit 19.

Furthermore, since the location of the first to third reinforcement ribs 26 to 28 in a predetermined manner as described above makes it possible to reduce the deformation of the chain case 8 caused by the vertical load acting on the mounting bracket unit 13 as well as the deformation of the first cylinder unit 18 and the second cylinder unit 19.

Still furthermore, when the fastener 24 of the chain case 8 is fastened to the engine body 2, a fastening bolt inserted in the fastener 24 has a function to prevent the deformation of the first cylinder unit 18 and the second cylinder unit 19 under the load of the mounting bracket unit 13.

Still furthermore, the presence of the first to third reinforcement ribs 26 to 28 extending obliquely below the fastener 24 and disposed so as to overlap the first cylinder unit 18 and the second cylinder unit 19 makes it possible to reduce the deformation of the first cylinder unit 18 and the second cylinder unit 19. In addition, during the manufacture of the chain case 8, the flow of molten metal to the mounting bracket unit 13 located at a high upper portion of the chain case 8 may be improved.

Still furthermore, since the mounting bracket unit 13 is disposed to the upper portion of the chain case 8, the first to third reinforcement ribs 26 to 28 as well as the inner ribs 29 inside the chain case 8 act to improve the rigidity of the upper portion of the chain case 8 and increase the fastening rigidity to the head cover 5, which makes it possible to reduce the radiated sound to be generated from a front surface of the head cover 5.

Still furthermore, as shown in FIG. 3, the third reinforcement rib 28 is disposed so as to obliquely intersect first axis 18C and second axis 19C of the first cylinder unit 18 and the second cylinder unit 19.

According to the above structure, a range in which the third reinforcement rib 28 intersects the first cylinder unit 18 and the second cylinder unit 19 is widened to thereby make it possible to reduce the deformation of the first cylinder unit 18 and the second cylinder unit 19.

Furthermore, as shown in FIGS. 1 and 2, the first cylinder unit 18 and the second cylinder unit 19 are placed under the mounting bracket unit 13 in a manner of being placed one over the other in a vertical direction.

Still furthermore, the second cylinder unit 19, which is the lower one of the first and second cylinder units 18 and 19, is offset in a direction along the outer wall 8A of the chain case 8 by a distance L1 from the first cylinder unit 18, which is the upper one of the cylinder units, toward the right edge 10, which is the other of the left edge 9 and right edge 10.

According to the structure mentioned above, in a case when a plurality of the first cylinder unit 18 and the second cylinder unit 19 are placed in the chain case 8, it is possible to link the left edge 9 and the right edge 10 with each other via the mounting bracket unit 13 and the plurality of the first cylinder unit 18 and the second cylinder unit 19, while reducing the flat portion on the outer wall 8A of the chain case 8, and accordingly, the vibrations of the chain case 8 can be suppressed.

As described above, the first cylinder unit 18 and the second cylinder unit 19 are disposed below the mounting bracket unit 13 by being placed one over the other in a vertical direction.

Figure 7:
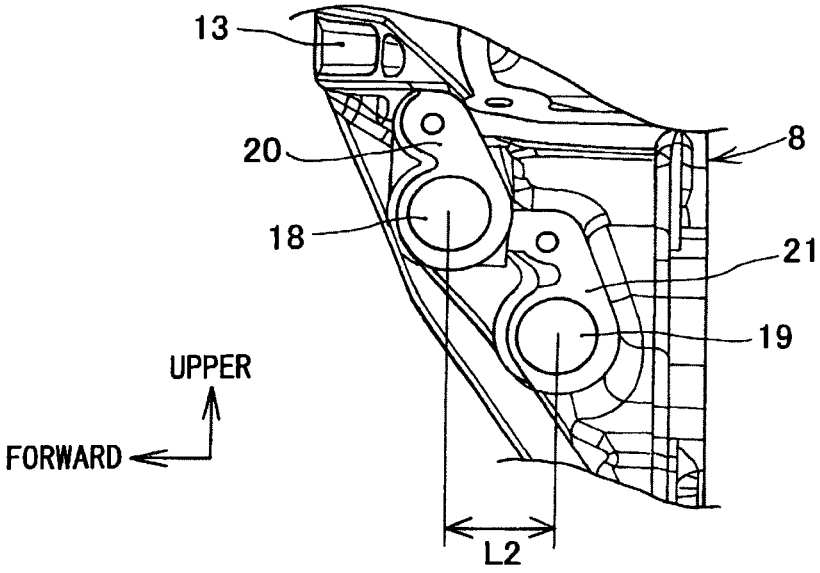
FIG. 7 is a front view of a cylinder boss region of the chain case as viewed in a direction perpendicular to a direction of a crank shaft of the engine according to the embodiment.
Figure 8:
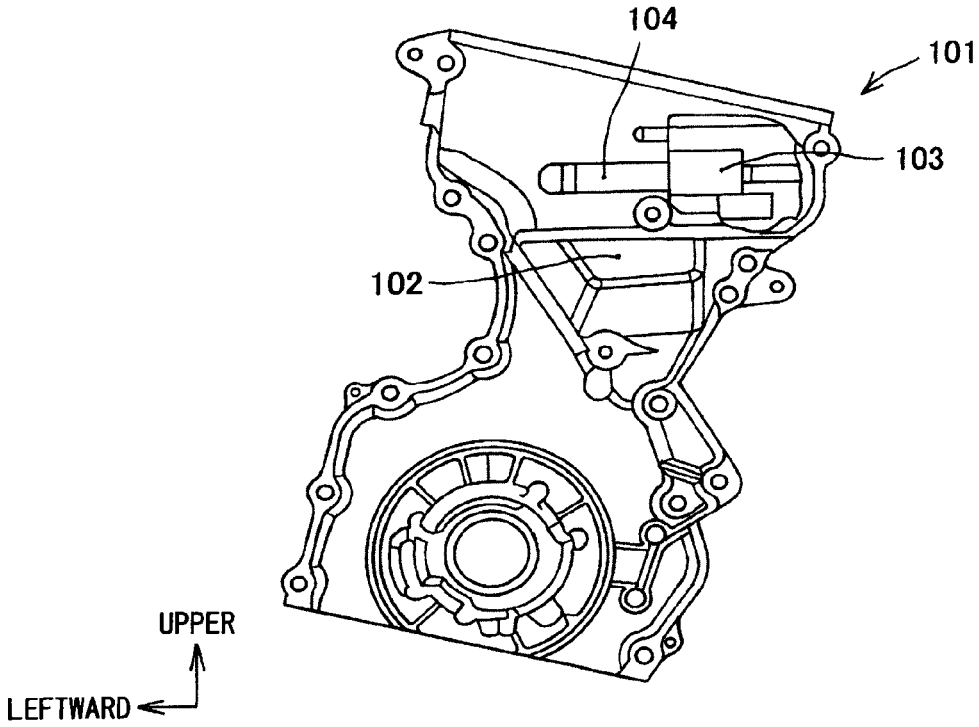
FIG. 8 PRIOR ART
FIG. 8 is a front view of a chain case of an engine according to a conventional technique.

Further, as shown in FIG. 7, when the chain case 8 is viewed in a direction orthogonal to the crank shaft direction, the first cylinder unit 18, which is the upper cylinder unit of the first and second cylinder units 18 and 19, is offset by a distance L2 so as to be located outside of the second cylinder unit 19, which is the lower cylinder unit, in the crank shaft direction.

As mentioned above, since the first cylinder unit 18 and second cylinder unit 19 are disposed in a manner offset from each other in the crank shaft direction, the plurality of first and second cylinder units 18 and 19 can be arranged linearly side by side between the a tip end portion, which is a most-easily-vibrated portion, of the mounting bracket unit 13 and the lower portion of the outer wall 8A of the chain case 8. Thus, it becomes possible to suppress the vibrations of the mounting bracket unit 13, thereby greatly reducing the vibrations of the chain case 8. In addition, two cylinder units, i.e., first cylinder unit 18 and second cylinder unit 19, can be arranged in vertically adjacent location, and the first cylinder boss portion 20 and the second cylinder boss portion 21, which are formed on the back sides thereof, respectively, and provided with the first oil passages 22 and the second oil passages 23, can be arranged compactly on an inner circumferential portions of the timing chain.

Moreover, since the first cylinder unit 18 and the second cylinder unit 19 are arranged in a manner offset from each other in the crank shaft direction, a step-like structure is formed on the chain case 8, making it possible to improve the surface rigidity of the chain case 8, and hence, reducing the radiated sound.

INDUSTRIAL APPLICABILITY

The chain case structure for an engine according to the present invention is applicable to various types of engines.

REFERENCE NUMERALS

1 - - - engine
2 - - - engine body
3 - - - cylinder block
4 - - - cylinder head
5 - - - head cover
7 - - - crank shaft
8 - - - chain case
9 - - - left side edge
10 - - - right side edge
11 - - - upper side edge
13 - - - mount bracket
14 - - - flat surface seat
15 - - - variable valve actuation mechanism
16 - - - first hydraulic control valve
17 - - - second hydraulic control valve
18 - - - first cylinder unit
19 - - - second cylinder unit
20 - - - first cylinder boss portion
21 - - - second cylinder boss portion
22 - - - first oil passage
23 - - - second oil passage
24 - - - fastening portion
26 - - - first reinforcement rib
27 - - - second reinforcement rib
28 - - - third reinforcement rib
29 - - - inner rib

The invention claimed is:

1. A chain case structure for an engine, in which a chain case is disposed at an end of an engine body of an engine such that a left edge and a right edge of the chain case are joined to an end of the engine body below a head cover of an engine and an upper edge of the chain case is joined to a lower portion of the head cover, and in which a mount bracket unit adopted to support the engine body and a cylinder unit, into which a hydraulic control valve of a variable valve actuation mechanism is inserted into a cylinder unit, are disposed so as to bulge out from an outer wall of the chain case, wherein both side portions of the mounting bracket unit in a width direction thereof are disposed so as to extend to one of the left edge and the right edge of the chain case and to the upper edge thereof, respectively, when the chain case is viewed in a direction of a crank shaft of the engine, a fastener adapted to fasten to the engine body is mounted to a lower portion of the mounting bracket unit, the cylinder unit is arranged under the fastener with an outer circumferential surface of the cylinder unit being coupled to the mounting bracket unit, and a reinforcement rib is disposed under the mounting bracket unit so as to extend downward from the mounting bracket unit by traversing the cylinder unit.

2. The chain case structure for an engine according to claim 1, wherein the reinforcement rib is disposed so as to extend from a lateral side of the fastener to another one of the left edge and the right edge of the chain case.

3. The chain case structure for an engine according to claim 1, wherein the reinforcement rib is disposed so as to obliquely intersect an axis of the cylinder unit.

4. The chain case structure for an engine according to claim 1, wherein a plurality of the cylinder units are placed below the mounting bracket unit in a manner being overlapped one over another in a vertical direction, and a lower cylinder unit of the plurality of cylinder units is offset from an upper cylinder unit toward the another one of the left edge and the right edge of the chain case in a direction along the outer wall of the chain case.

5. The chain case structure for an engine according to claim 1, wherein a plurality of the cylinder units are placed below the mounting bracket unit in a manner being overlapped one over another in a vertical direction; and when the chain case is viewed in a direction orthogonal to the crank shaft, an upper cylinder unit of the plurality of cylinder units is offset so as to be located further outside in the axial direction of the crank shaft than a lower cylinder unit of the plurality of cylinder units.

* * * * *